United States Patent [19]

Kayukawa et al.

[11] Patent Number: 4,730,986

[45] Date of Patent: Mar. 15, 1988

[54] VARIABLE DISPLACEMENT WOBBLE PLATE TYPE COMPRESSOR WITH WOBBLE ANGLE CONTROL VALVE

[75] Inventors: Hiroaki Kayukawa; Masaki Ohta; Shinichi Suzuki; Kenji Takenaka, all of Kariya, Japan

[73] Assignee: Kabushiki Kaisha Toyoda Jidoshokki Seisakusho, Aichi, Japan

[21] Appl. No.: 40,484

[22] Filed: Apr. 20, 1987

[30] Foreign Application Priority Data

Apr. 25, 1986 [JP] Japan ..... 61-097246

[51] Int. Cl.[4] ..... F04B 49/00; F04B 1/76

[52] U.S. Cl. ..... 417/222; 417/270

[58] Field of Search ..... 417/218, 222, 270

[56] References Cited

U.S. PATENT DOCUMENTS 4,674,957 6/1987 Ohta et al. ..... 417/222
4,685,866 4/1987 Takenaka et al. ..... 417/222
4,688,997 7/1987 Suzuki et al. ..... 417/222

FOREIGN PATENT DOCUMENTS 3545581 7/1986 Japan ..... 417/222

*Primary Examiner*—William L. Freeh
*Attorney, Agent, or Firm*—Burgess, Ryan & Wayne

[57] ABSTRACT

A variable displacement wobble plate type compressor with a variable angle non-rotary wobble plate, having a suction chamber for refrigerant before compression, a discharge chamber for refrigerant after compression, suction, and compression, and discharge cylinder bores, pistons reciprocated by the wobble plate within the cylinder bores for compressing the refrigerant, a crankcase with a crank chamber to receive therein a drive and a wobble plate mechanism mounted about a drive shaft connectable to a rotary drive source, i.e., a vehicle engine, connected to the pistons to cause reciprocating motion of the pistons and capable of changing the wobble angle thereof, a first communication passageway providing a fluid communication between the crankcase chamber and the discharge chamber, a first control valve for closing and opening the first passageway in response to a change in a fluid pressure indicative of a refrigerating load change, a second communication passageway for permitting adjustable evacuation of a blowby gas from the crankcase chamber to the suction chamber, and a second control valve changing an extent of opening of the second communication passageway in response to an electrical signal or signals indicating a change in a physical value relative to the air-conditioning circuit and the vehicle as well as in response to a change in a fluid pressure level in the crankcase chamber.

10 Claims, 8 Drawing Figures

VARIABLE DISPLACEMENT WOBBLE PLATE TYPE COMPRESSOR WITH WOBBLE ANGLE CONTROL VALVE

BACKGROUND OF THE INVENTION

1. Field of the Invention

The present invention relates to a variable displacement compressor for use in an automotive air-conditioning system and, more specifically, to a variable displacement wobble plate type compressor provided with a control valve, having a suction chamber, a discharge chamber, and a crankcase and capable of varying the stroke of the pistons thereof according to a difference between the crankcase pressure and suction pressure to vary the wobble angle of the wobble plate to control the compression displacement.

2. Description of the Related Art

A variable displacement compressor of a variable angle wobble plate type is disclosed in U.S. Pat. No. 4,428,718 granted to T. J. Skinner. In this compressor, when the suction pressure drops due to a drop in the cooling load or an increase in the rotating speed of the compressor, the bellows of a displacement control valve expand due to a variation of the balance between the discharge pressure and the atomospheric pressure, to operate the valve element and close an exhaust passage interconnecting the crankcase and the suction chamber, and to operate another valve element interlocked with the former valve element to open a supply passage interconnecting the discharge chamber and the crankcase, to increase the pressure difference between the fluid pressure in the crankcase chamber and the suction pressure by supplying a high pressure refrigerant gas into the crankcase chamber. The supply of the high pressure refrigerant gas into the crankcase increases the fluid pressure acting on the back face of each piston and shortens the stroke of each piston, to prevent a drop in the suction pressure of the compressor while decreasing the compressor displacement.

However, the above-mentioned conventional variable displacement compressor has a drawback in that, when the supply of the high pressure refrigerant gas from the discharge chamber to the crankcase chamber is interrupted during the operation of the compressor, the regrigerant gas is unable to immediately escape from the crankcase chamber to the suction chamber via the exhaust passageway. This is because the extent of opening of the exhaust passageway per se, i.e., the amount of restriction of the exhaust passageway, is constant and unchangeable. As a result, when the cooling load to the compressor is increased, the compressor is unable to quickly increase the compression displacement. That is, the response characteristics of the conventional variable displacement wobble plate type compressor are unsatisfactory during control of the compressor displacement in response to a change in the cooling load.

SUMMARY OF THE INVENTION

Therefore, an object of the present invention is to obviate the defects of the conventional variable displacement wobble plate type compressor.

Another object of the present invention is to provide a variable displacement wobble plate type compressor with a wobble angle control valve, capable of quickly controlling the wobble angle of the wobble palte in response to a change in a cooling load applied to an air-conditioning circuit in which the compressor is accommodated.

A further object of the present invention is to provide a variable displacement wobble plate type compressor with a wobble angle control valve, capable of changing the compressor displacement in accordance with an external electrical signal or signals indicating a physical parameter relative to the air-conditioning of an engine-operated vehicle.

A still further object of the present invention is to provide a variable displacement wobble plate type compressor wherein the displacement thereof can be changed over a wide range, i.e., from a very small displacement to a large displacement.

In accordance with the present invention, there is provided a variable displacement wobble plate type compressor adapted for use in an air-conditioning circuit of a vehicle, comprising:

a housing element having therein a suction chamber for a refrigerant before compression and a discharge chamber for a refrigerant after compression;

a cylinder block defining therein a plurality of cylinder bores arranged so as to surround an axial drive shaft and having therein associated reciprocatory pistons disposed so as to draw the refrigerant from the suction chamber and to then discharge the refrigerant after compression into the discharge chamber;

a crankcase having defined therein a chamber communicating with the cylinder bores and containing therein a drive plate mounted in such a manner that it is capable of rotating with the drive shaft as well as changing an inclination thereof with respect to the drive shaft, and a non-rotating wobble plate held by the drive plate;

a plurality of connecting rods connected between the wobble plate and the pistons;

a first passageway for fluidly communicating the chamber of the crankcase with the discharge chamber of the housing element;

a first valve arranged in the first passageway, for opening and closing the first passageway;

a second passageway for providing a fluid communication between the chamber of the crankcase and the suction chamber of the housing element;

a second valve arranged in the second passageway, for varying an extent of opening of a part of the second passageway;

a first valve control means including a first means for sensing a change in a fluid pressure value indicative of a change in a regrigerating load applied to the air-conditioning circuit, with respect to a predetermined first level, and a second means for controlling an operation of the first valve in response to a signal from the first means, the first valve control means mechanically moving the first valve between a first position opening a part of the first passageway and a second position closing that part of the first passageway, and;

a second valve control means including a first actuating means for electrically actuating the second valve in response to at least one of electrical signals indicating a change in a physical value relative to the air-conditioning circuit and the vehicle to be air-conditioned, respectively, the first actuating means of the second valve control means moving the second valve between a first position minimizing the extent of opening of the part of the second passageway and a second position maximizing the extent of opening of the part of the second passageway.

When the cooling load is increased and the second valve is electrically opened in response to an external electrical signal or signals in a state where the first valve is closed to shut off the first passageway, the extent of opening of the second passageway is increased to allow an immediate and rapid return of the refrigerant from the crankcase chamber toward the suction chamber through the second passageway; consequently, the fluid pressure in the crankcase chamber drops instantly, the difference in the fluid pressure between the crankcase chamber and the suction chamber diminishes, and the compressor displacement increases. Thus, the responce characteristics in the control of the compressor displacement in response to an increase in the cooling load can be enhanced.

BRIEF DESCRIPTION OF THE DRAWINGS

The above and other objects, features and advantages of the present invention will become more apparent from the ensuing description of the embodiments of the present invention taken in conjunction with the accompanying drawings, wherein.

DESCRIPTION OF THE PREFERRED EMBODIMENTS

Figure 2:
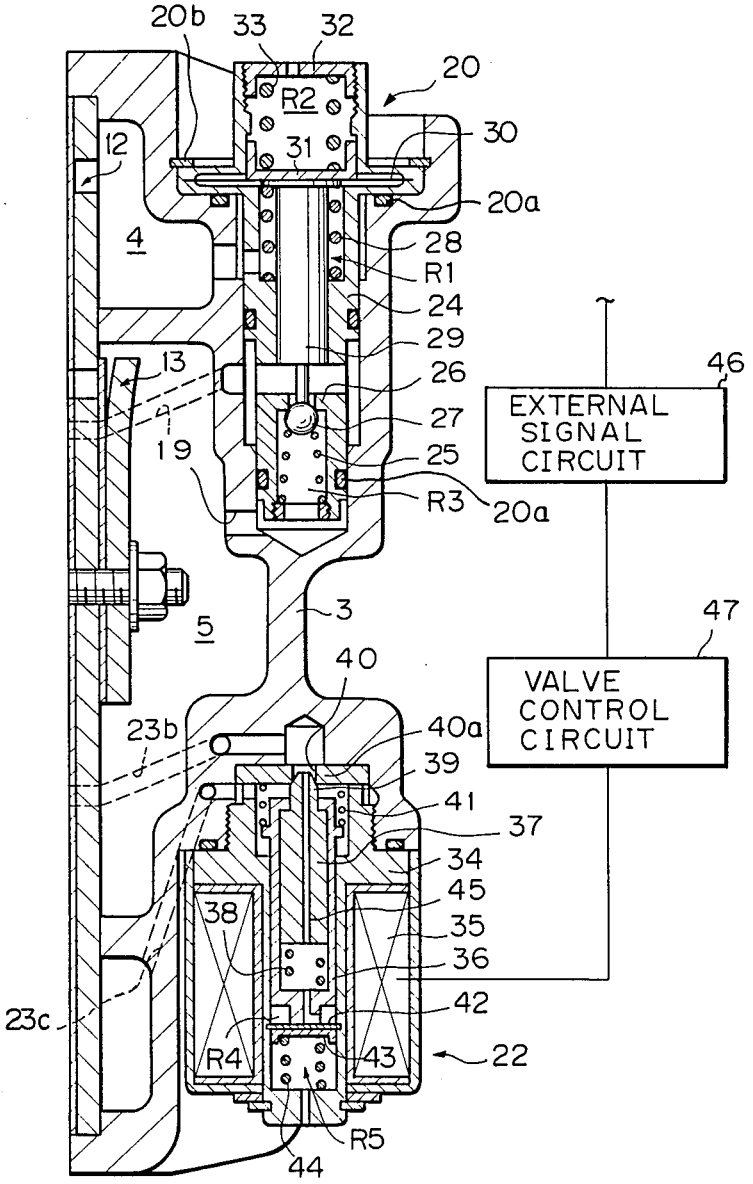
FIG. 2 is an enlarged fragmentary sectional view of a first displacement control valve and a second displacement control valve, in which the second displacement control valve is closed.
Figure 3:
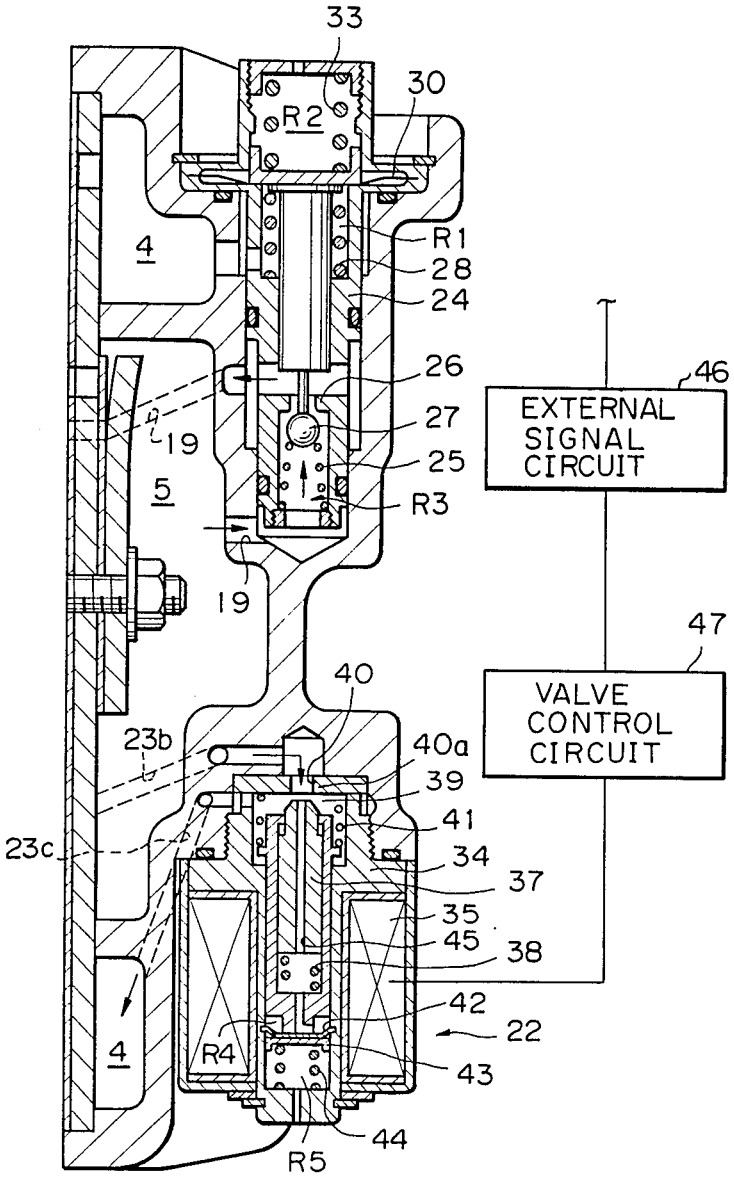
FIG. 3 is an enlarged fragmentary sectional view, similar to FIG. 2, in which the second displacement control valve is open.

A variable displacement wobble plate type compressor, in a preferred embodiment, according to the present invention will be described hereinafter with reference to FIGS. 1 to 3.

Figure 1:
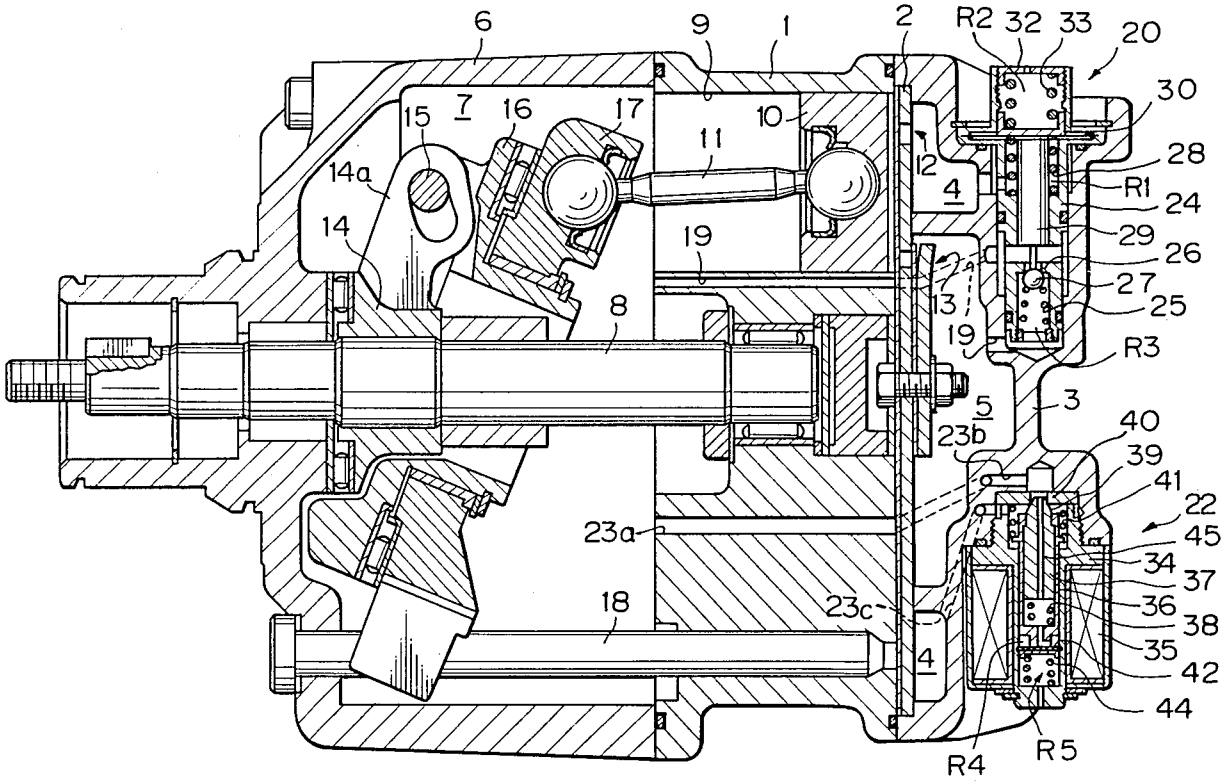
FIG. 1 is a longitudinal cross sectional view of a variable displacement wobble plate type compressor with a wobble angle control valve according to a first embodiment of the present invention.

Referring to FIG. 1, a rear housing 3 is secured through a valve plate 2 to the right end face of a cylinder block 1. An annular suction chamber 4 and a discharge chamber 5 are formed along the inner circumference and in the central section, respectively, of the rear housing 3. The suction chamber 4 and the discharge chamber 5 are connected through a suction port (not shown) and a discharge port (not shown), respectively, to an external cooling circuit. A front housing or a crankcase 6 in the shape of a bell-jar is secured to the left end face of the cylinder block 1 to define a crankcase chamber 7 therein. A driving shaft 8 which is driven for rotation by an engine (not shown) is journaled on the cylinder block 1 and the front housing 6.

Six cylinder bores 9 (only one shown) are formed through the cylinder block 1 with their axes in parallel to the driving shaft 8. A piston 10 is fitted for reciprocatory sliding motion in each cylinder bore 9, and a connecting rod 11 is connected at one end thereof to the left end of the piston 10 via a ball and socket joint. Suction valve mechanisms 12 are formed in the valve plate 2 permit the flow of a refrigerant gas into the compression chamber of the corresponding cylinder bore 9. Discharge valve mechanisms 13 are also formed in the valve plate 2 to permit the discharge of the refrigerant gas compressed in the compression chamber of the corresponding cylinder bore 9 into the discharge chamber 5.

A drive element 14, referred to as lug plate, is fixedly mounted on the drive shaft 8. A tiltable drive plate 16 is interlocked with the drive element 14 for rotation together with the drive element 14 by a guide pin 15 fitted in a slot formed in a lug 14*a* projecting from the drive element 14.

A wobble plate 17 is supported on the drive plate 16 so as to wobble together with the drive plate 16 and is restrained from rotation by a guide rod 18 extended at a fixed position. The connecting rods 11 are connected at the respective left ends thereof to the wobble plate 17 via respective ball and socket joints. When the drive element 14 is rotated by the drive shaft 8, the wobble plate 17 wobbles to drive the pistons 10 through the connecting rods 11 for reciprocatory motion. The stroke of the piston 10 is dependent on the pressure difference $\Delta p = Pc - Ps$, where Pc is the pressure in the crankcase chamber 7 and Ps is the pressure in the suction chamber 4. That is, the stroke of the piston 10 is decreased and the wobble angle of the wobble plate 17 is decreased to reduce the compression displacement as the pressure difference $\Delta p$ is increased, and the stroke of the piston 10 is increased and the wobble angle of the wobble plate 17 is increased to increase the compression displacement as the pressure difference $\Delta p$ is decreased. The constitution of the variable displacement wobble plate type compressor described above is the same as that of the conventional variable displacement compressor.

A gas supply passageway 19 is formed through the rear housing 3, the valve plate 2, and the cylinder block 1 to introduce the compressed refrigerant gas into the crankcase chamber 7 from the discharge chamber 5. A first displacement control valve 20, described hereinafter, is provided in the gas supply passageway 19. To return the refrigerant gas leaked from the compression chamber of the cylinder bore 9 into the crankcase chamber 7 due to blow-by or the refrigerant gas supplied from the discharge chamber 5 into the crankcase chamber 7 from the crankcase chamber 7 to the suction chamber 4, a gas exhaust passageway 23 is formed through the cylinder block 1, the valve plate 2, and the rear housing 3. The extent of opening of the gas exhaust passageway 23 is regulated when necessary by a second displacement control valve 22, which is a solenoid-operated control valve. The gas exhaust passageway 23 has a passageway portion 23*a* formed in the cylinder block 1, a passageway portion 23*b* formed through the valve plate 2 and the rear housing 3, and a passageway portion 23*c* formed in the rear housing 3.

The first displacement control valve 20 will be described with reference to FIG. 2. A cylindrical valve housing 24 is fixedly screwed in the rear housing 3. A ball valve 27 is received in the valve housing 24 for reciprocatory motion therein and is biased upward, namely, in a closing direction, by a compression spring 25 so as to be seated on a valve seat 26. A valve rod 29 for actuating the ball valve 27 is provided above the ball valve 27 in the valve housing 24 and is biased upward, namely, in a closing direction, by a compression spring 28 having one end seated on a shoulder formed in the valve housing 24 and the other end in contact with the upper flange of the valve rod 29, so that the valve rod 29 is in contact with a diaphragm 30 at the upper end face thereof. The valve rod 29 and the diaphragm 30 are biased downward, namely, in an opening direction, by a compression spring 33 compressed between a sliding spring receipt 31 and a fixed spring receipt 32 and having a resilience greater than the compression spring 28. The diaphragm 30 may be substituted by a bellows or an equivalent device, i.e., in general, a pressure-sensitive membrane member. Indicated at 20*a* is a sealing O-ring and at 20*b* is a snap ring.

The cavity formed below the diaphragm 30 and accommodating the compression spring 28 is a first pressure chamber R1 communicating with the suction chamber 4. A second pressure chamber R2 accommodating the compression spring 33 communicates with the atmosphere. The cavity accommodating the ball valve 27 is a third pressure chamber R3 communicating with the discharge chamber 5. When the total force of the atmospheric pressure prevailing in the second pressure chamber R2 and the resilience of the compression spring 33 exceeds the total force of the pressure prevailing in the first pressure chamber R1 and the resilience of the compression spring 28 due to the fall of the suction pressure Ps prevailing in the first pressure chamber R1, the ball valve 27 is shifted downward, namely in the opening direction, as shown in FIG. 3, to permit the compressed refrigerant gas to flow from the discharge chamber 5 through the gas supply passageway 19 into the crankcase chamber 7 to enhance the pressure Pc in the crankcase chamber 7 so that the compression displacement is reduced.

The second displacement control valve 22 comprises a valve housing 34 fixedly screwed in the rear housing 3, a solenoid 35 mounted on the valve housing 34 so as to receive a portion of the valve housing 34 in the central bore thereof, a valve holding cylinder 36 slidably received in the valve housing 34 for axial movement, a movable magnetic core 37 slidably received in the valve holding cylinder 36 for axial movement in a fixed range of stroke, and a compression spring 38 biasing the core 37 upward, namely, in a closing direction. A vlave element 39 is formed integrally with the core 37 at the upper end thereof and is seated on a valve seat member 40 having a port 40*a* provided in the passageway portion 23*b* of the rear housing 3. A compression spring 41 is compressed between the valve holding cylinder 36 and the valve seat member 40 to bias the valve element 39 in an opening direction.

The valve holding cylinder 36 is in abutment at the lower end thereof with a diaphragm 42 or an equivalent, i.e., in general, a pressure-sensitive membrane member, which is urged by a compression spring 44 provided between a spring receipt 43 placed under the valve holding cylinder 36 and the inner bottom surface of the valve housing 34 to bias the valve holding cylinder 36 in a closing direction. The passageway portion 23*b* and a first pressure chamber R4 are interconnected by a passageway 45 formed through the core 37, the valve element 39, and the valve holding cylinder 36. A second pressure chamber R5 accommodating the compression spring 44 communicates with the atmosphere. When the total force of the pressure Pc in the crankcase chamber 7 is applied to the first pressure chamber R4, the resilience of the compression spring 41 and the respective dead weights of the valve holding cylinder 36 and the core 37 exceed the total force of the atmospheric pressure working in the second pressure chamber R5 and the resilience of the compression spring 44, namely, when the pressure Pc exceeds a present pressure $P_A$ due to the blow-by of the refrigerant gas from the respective compression chambers into the crankcase chamber 7, the valve holding cylinder 36, the core 37 and the valve element 39 are moved mechanically downward, and thus the gas exhaust passageway 23 is opened so that the refrigerant gas is returned from the crankcase chamber 7 through the gas exhaust passageway 23 to the suction chamber 4 to suppress a pressure rise in the crankcase chamber 7 attributable to the blow-by regrigerant gas.

On the other hand, an external signal circuit 46 including a pressure sensor is provided in the front housing 6. The external detection signal circuit 46 provides an external detection signal corresponding, for example, to the pressure Pc working in the crankcase chamber 7. The pressure sensor is connected to a valve control circuit 47, which in turn is connected to the solenoid 35. When a detected value of the pressure Pc in the crankcase chamber 7 detected by the pressure sensor becomes as great as a pre-set value $P_A'$ and greater than the pre-set pressure $P_A$, the valve control circuit 47 supplies an exciting current to the solenoid 35. Then the valve element 39 is moved axially together with the core 37 against the resilience of the compression spring 38 from the position shown in FIG. 2 to the position shown in FIG. 3 to open the central port 40*a* to an extent greater than an extent to which the valve port 40*a* is opened by mechanically moving the valve element 39 so that the maximum flow passageway area is provided. Thus, the refrigerant gas is allowed to flow from the crankcase chamber 7 through the central port 40*a* opened to the maximum extent and the passageway portions 23*b* and 23*c* into the suction chamber 4, so that the pressure Pc in the crankcase chamber 7 drops rapidly to increase the compression diplacement.

The operation of the variable displacement wobble plate type compressor thus constructed will be described hereinafter.

When the temperature in the pressure room of a vehicle is high, and thus the cooling load is high at the start of operation of the variable displacement wobble type compressor, the pressure Ps in the suction chamber 4 is higher than a pre-set value $Ps_O$. Therefore, the first displacement control valve 20 is closed to shut the gas supply passageway 19, and on the other hand, since the pressure Pc in the crankcase chamber 7 is higher than the pre-set value $P_A'$, the solenoid 35 of the second displacement control valve 22 is energized to open the gas exhaust passageway 23 to the maximum extent to return the refrigerant gas from the crankcase chamber 7 to the suction chamber 4. The blow-by refrigerant gas leaked from the compression chambers of the cylinder bores 9 is also returned through the gas exhaust passageway 23 to the suction chamber 4. Under such a condition, the pressure difference $\Delta p$ between the . pressure Pc in the crankcase chamber 7 and the pressure Ps in the suction chamber 4 is maintained below a present value $\Delta p_O$; consequently, the piston 10 are reciprocated at the maximum stroke and the wobble plate 17 wobbles at the maximum wobble angle for operation at the full compression displacement.

As the operation is continued, the pressure Ps in the suction chamber 4 and the pressure Pc in the crankcase chamber 7 fall gradually. Upon the fall of the pressure Pc in the crankcase chamber 7 to the pre-set value $P_A'$, the valve control circuit 47 stops the supply of the exciting current to the solenoid 35, and thus the operation of the valve element 39 is mechanically controlled by the pressure Pc in the crankcase chamber 7. In this state, the operating cycle of the valve element 39 for opening and closing the port 40*a* is repeated at samll intervals on the basis of the present value $P_A$ smaller than the pre-set value $P_A'$ to suppress the abnormal rise in the pressure Pc in the crankcase chamber 7 attributable to the blowby refrigerant gas leaked from the compression chambers into the crankcase chamber 7.

Thus, the temperature in the passenger compartment is reduced and therefore the cooling load is reduced. Then, upon the drop of the pressure Ps in the suction chamber 4 below the pre-set value $Ps_O$, the first displacement control valve 20 is opened to supply the high-pressure refrigerant gas from the discharge chamber 5 through the gas supply passageway 19 into the crankcase chamber 7; consequently the pressure Pc in the crankcase chamber 7 is increased and, accordingly, the pressure difference Δp increases, so that the stroke of the pistons 10 is reduced, and thus the wobble angle of the wobble plate 17 is changed to reduce the compression displacement. If the pressure Pc in the crankcase chamber 7 rises beyond the pre-set value $P_A$ up to the pre-set value $P_A'$, the second displacement control valve 22 is opened to rapidly reduce the pressure Pc in the crankcase chamber 7 thereby to suppress the drop of the compression displacement. That is, when the compression displacement is at a low level, the compression displacement can be increased rapidly and the response characteristics of the displacement control are improved.

Upon the rise of the pressure Ps of the suction chamber 4 beyond the pre-set value $Ps_O$ due to an increase in the cooling load, the first displacement control valve 20 is closed to interrupt the supply of the high-pressure refrigerant gas from the discharge chamber 5 into the crankcase chamber 7; consequently, the pressure difference Δp between the pressure Pc in the crankcase chamber 7 and the pressure Ps in the suction chamber 4 is reduced, so that the compression displacement is increased.

The extent of opening of the second displacement control valve 22 can be regulated by electromagnetically varying the ratio of the valve opening time to the valve closing time (the duty ratio) by the valve control circuit 47.

Figure 4:
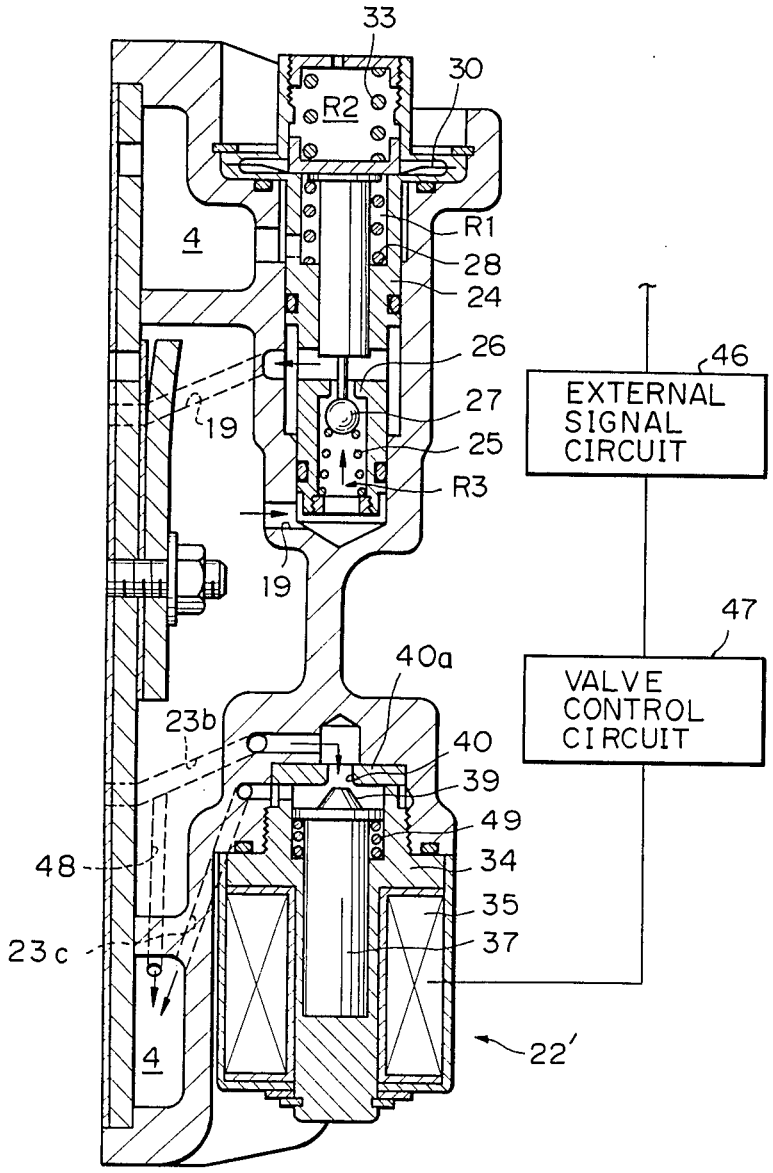
FIG. 4 is an enlarged fragmentary sectional view of a variable displacement wobble plate type compressor employing a different second displacement control valve; and, FIGS. 5A through 5D are diagrammatic views of various embodiments of the first displacement control valve employed by a variable displacement wobble plate type compressor with a wobble angle control valve according to the present invention.

Referring to FIG. 4 which illustrates a variable displacement wobble plate type compressor according to a second embodiment of the present invention, the compressor has an additional fixed gas exhaust passageway 48 extending between the passageway portion 23*b* and the suction chamber 4 so as to constantly return the blowby refrigerant gas from the crankcase chamber (not shown in FIG. 4) to the suction chamber 4, while the passageway portions 23*b* and 23*c* are fluidly connected and disconnected by the second displacement control valve 22' in the same manner as the previous embodiment. The mode of compression displacement control of the second embodiment of FIG. 4 is the same as the foregoing first embodiment.

The above-described embodiments of the present invention may be modified to the following constitutions.

Figure 5A:
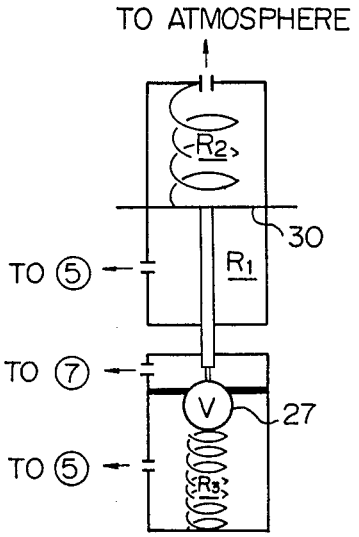
Figure 5B:
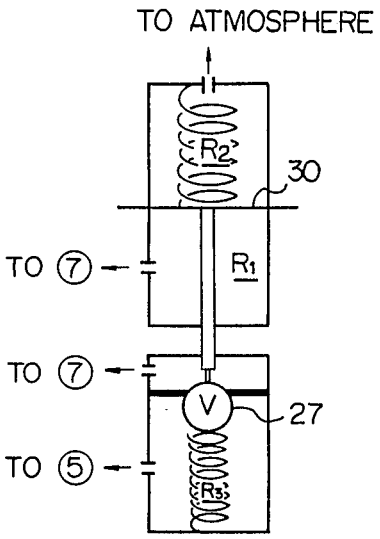
Figure 5C:
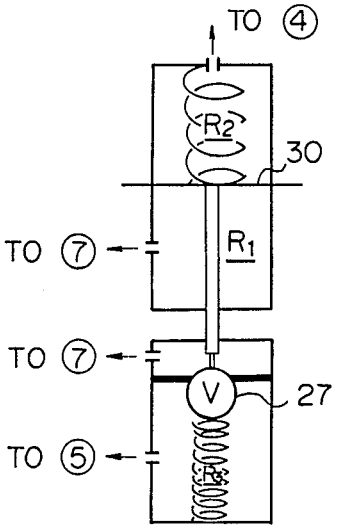
Figure 5D:
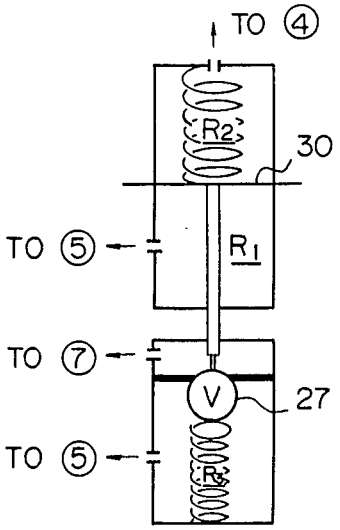

(1) In the above-described embodiments, the first displacement control valve 20 arranged in the high pressure refrigerant supply passageway 19 is actuated by the fluid pressure Ps of the suction chamber 4 so as to control the movement of the valve rod 29. The first displacement control valve 20 may be designed so that the extent of opening thereof is changed by the movement of the ball valve 27 and the valve rod 29 according to one of the pressure circuit arrangements as shown in FIGS. 5A through 5D. For example, FIG. 5A illustrates the case where the extent of opening of the first displacement control valve 20 increases when the discharge as pressure Pd increases with respect to a pre-set pressure value, and FIG. 5B illustrates the case where the extent of opening of the first displacement control valve 20 increases when the crankcase pressure Pc increases with respect to a pre-set pressure value. Moreover, FIGS. 5C and 5D illustrate the cases where the extent of opening of the first displacement control valve 20 is increased when the pressure difference $\Delta p = Pc - Ps$ is decreased and when the pressure difference $\Delta p' = Pd - Ps$ is increased.

In the foregoing embodiments, the second displacement control valve 22 is opened when the electric external detection signal corresponding to the fluid pressure Pc in the crankcase chamber 7 detected by the pressure sensor consisting of, e.g., a conventional piezo-electric element, reaches the pre-set value $P_A'$. The electric external detection signal for opening the second displacement control valve 22 may be an external electrical detection signal corresponding to (a) a rise in the temperature of the suction refrigerant gas detected at the input of the compressor by a conventional thermoelectric element, (b) a rise in the temperature of the refrigerant gas detected at the outlet position of the evaporator of the air-conditioning circuit by the conventional thermo-electric element, (c) a rise in the temperature of the passenger compartment of a vehicle to be air-conditioned detected by the conventional thermoelectric element, (d) an increase in the intensity of solar radiation detected by a conventional light-sensitive element, such as a photo-transister, (e) a reduction in the suction load of a vehicle engine detected by a pressure-sensitive element, (f) a reduction of the degree of opening of the vehicle accelerometer detected by a conventional potentiometer deivce, (g) a reduction of the vehicle acceleration detected an appropriate accelerometer device, (h) a reduction of the vehicle engine speed detected by a conventional tachometer device, or (i) a reduction of the running speed of the vehicle detected by detecting, e.g., the gear position of a transmission of the vehicle to be air-conditioned. Further, if preferable, a plurality of the above-mentioned external electric detection signals may be used for controlling the second displacement control valve 2.

As apparent from the foregoing description, according to the present invention, the second displacement control valve 22 is fully opened when necessary to return the refrigerant gas rapidly from the crankcase chamber through the gas exhaust passageway to the suction chamber to increase the compression displacement quickly in response to the increase in the cooling load, so that the response characteristics of the displacement control are improved.

Although the invention has been described in its preferred forms with a certain degree of particularity, it should be understood that many modifications of the present invention will occur to those skilled in the art without departing from the scope and spirit of the present invention claimed in the appended claims.

We claim:

1. A variable displacement wobble plate type compressor adapted for use in an air-conditioning circuit of a vehicle, comprising:

a housing element having therein a suction chamber for a refrigerant before compression and a discharge chamber for a refrigerant after compression;

a cylinder block defining therein a plurality of cylinder bores arranged so as to surround an axial drive shaft and having therein associated reciprocatory pistons disposed so as to draw the refrigerant from the suction chamber and to then discharge the refrigerant after compression into the discharge chamber;

a crankcase having defined therein a chamber communicating with the cylinder bores and containing therein a drive plate mounted in such a manner that it is capable of rotating with the drive shaft as well as changing an inclination thereof with respect to the drive shaft and a non-rotating wobble plate held by the drive plate;

a plurality of connecting rods connected between said wobble plate and the pistons;

a first passageway means for fluidly communicating said chamber of said crankcase with said discharge chamber of said housing element;

a first valve means arranged in said first passageway means, for opening and closing said first passageway means;

a second passageway means for providing a fluid communication between said chamber of said crankcase and said suction chamber of said housing element;

a second valve means arranged in said second passageway means, for varying an extent of opening of a part of said second passageway means;

a first valve control means including a first means for sensing a change in a fluid pressure value indicative of a change in a refrigerating load applied to said air-conditioning circuit, with respect to a predetermined first level, and a second means for controlling an operation of said first valve means in response to a signal from said first means, said first valve control means mechanically moving said first valve means between a first position opening a part of said first passageway means and a second position closing said part of said first passageway means, and;

a second valve control means including a first actuating means for electrically actuating said second valve means in response to at least one of electrical signals indicating a change in a physical value relative to said air-conditioning circuit and the vehicle to be air-conditioned, respectively, said first actuating means of said second valve control means moving said second valve means between a first position minimizing the extent of opening of said part of said second passageway means and a second position maximizing the extent of opening of said part of said second passageway means.

2. A variable displacement wobble plate type compressor according to claim 1, wherein said fluid pressure value indicative of a change in a refrigerating load applied to said air-conditioning circuit comprises one of fluid pressure values including a fluid pressure in said suction chamber, a fluid pressure in said chamber of said crankcase, a fluid pressure in said discharge chamber, a difference between said fluid pressures in said suction chamber and said discharge chamber, and a difference between said fluid pressures in said crankcase chamber and said suction chamber.

3. A variable displacement wobble plate type compressor according to claim 1, wherein said first means of said first valve control means comprises a pressure sensitive membrane element defining on both sides thereof a first and a second pressure chambers, one of which receives said fluid pressure value indicative of a change in a refrigerating load applied to said air-conditioning circuit, and wherein said second means of said first valve control means comprises a rod element having one end connected to said pressure sensitive membrane element and the other end moving a valve element of said first valve means.

4. A variable displacement wobble plate type compressor according to claim 1, wherein said second valve means comprises:

a valve seat member arranged midway in said second passageway means and having a valve port formed in said seat member;

a valve element movable so as to open and close said valve port, said valve element including a magnetically responsive core member; and, a valve housing receiving therein said valve element, wherein said first actuating means of said second valve control means comprises a solenoid arranged so as to surround said core member of said valve element, said solenoid magnetically moving said core member of said valve element upon being energized in response to said at least one of said electrical signals.

5. A variable displacement wobble plate type compressor according to claim 1, wherein said physical value relative to said air-conditioning circuit and said vehicle to be air-conditioned comprises at least one of a number of revolutions of an engine of said vehicle, a temperature at an output end of an evaporator of said air-conditioning circuit, a temperature of said refrigerant before compression, a temperature in a compartment of said vehicle, and a speed of said vehicle.

6. A variable displacement wobble plate type compressor according to claim 1, further comprising a third fixed passageway means for providing a constantly throttle communication between said crankcase chamber and said suction chamber thereby permitting a blowby gas to be evacuated from said crankcase chamber to said suction chamber during operation of said compressor.

7. A variable displacement wobble plate type compressor according to claim 1, wherein said second valve control means further includes a second actuating means for mechanically actuating said second valve means in response to a change in a fluid pressure in said chamber of said second actuating means moving said second valve means from said first position to a third position partly increasing the extent of opening of said part of said second passageway means when the fluid pressure in said crankcase chamber is larger than said predetermined second pressure level.

8. A variable displacement wobble plate type compressor according to claim 7, wherein said second actuating means comprises a pressure sensitive membrane element defining on both sides thereof a first pressure chamber communicated with the atmosphere and a second pressure chamber communicated with said crankcase chamber, said pressure sensitive membrane element being operatively connected to said magnetically responsive core member of said valve element of said second valve means.

9. A variable displacement wobble plate type compressor according to claim 1, wherein said first valve means and said first valve control means are formed in a unitary valve assembly, and wherein said second valve means and said second valve control means are formed in a different unitary valve assembly.

10. A variable displacement wobble plate type compressor according to claim 9, wherein said unitary valve assemblies are built in said housing element.

* * * * *